US009200879B2

(12) United States Patent
Kumano

(10) Patent No.: US 9,200,879 B2
(45) Date of Patent: Dec. 1, 2015

(54) SEA-BASED BUOYANCY TYPE TORPEDO STORAGE AND LAUNCH SYSTEM, TORPEDO STORAGE AND LAUNCH APPARATUS, AND BUOYANT RISE TYPE TORPEDO

(71) Applicant: Japan System Planning Co., Ltd., Tokyo (JP)

(72) Inventor: Katsuyuki Kumano, Tokyo (JP)

(73) Assignee: JAPAN SYSTEM PLANNING CO., LTD., Tokyo (JP)

( * ) Notice: Subject to any disclaimer, the term of this patent is extended or adjusted under 35 U.S.C. 154(b) by 225 days.

(21) Appl. No.: 13/929,778

(22) Filed: Jun. 28, 2013

(65) Prior Publication Data

US 2014/0209003 A1 Jul. 31, 2014

(30) Foreign Application Priority Data

Dec. 27, 2012 (JP) ..... 2012-284440

(51) Int. Cl.
*F42B 22/10* (2006.01)
*F42B 19/06* (2006.01)
*F41F 3/10* (2006.01)

(52) U.S. Cl.
CPC .. *F42B 19/06* (2013.01); *F41F 3/10* (2013.01)

(58) Field of Classification Search
CPC ..... F42B 19/00; F42B 19/005; F42B 19/125; F42B 15/20; F42B 22/00; F41F 3/10; F41F 3/07; F42C 14/04; B63G 3/02; B63G 8/30; B63G 8/32
USPC ..... 89/5, 1.809, 1.81; 102/341, 390, 399, 102/409, 406
See application file for complete search history.

(56) References Cited

U.S. PATENT DOCUMENTS

| | | | | | |
|---|---|---|---|---|---|
| 2,818,807 | A | * | 1/1958 | Tracey, Jr | 102/411 |
| 3,137,203 | A | * | 6/1964 | Brown | 89/1.81 |
| 3,811,379 | A | * | 5/1974 | Sondheimer | 102/413 |
| 4,003,291 | A | * | 1/1977 | Vass et al. | 89/1.81 |
| 4,274,333 | A | * | 6/1981 | Lampton | 102/418 |
| 4,395,952 | A | * | 8/1983 | Hickey | 102/411 |
| 4,566,367 | A | * | 1/1986 | Hickey | 89/1.81 |
| 4,586,421 | A | * | 5/1986 | Hickey et al. | 89/1.81 |
| 5,170,005 | A | * | 12/1992 | Mabry et al. | 89/1.81 |

(Continued)

FOREIGN PATENT DOCUMENTS

| | | | | |
|---|---|---|---|---|
| DE | 3924416 A1 | * | 1/1993 | F42B 19/00 |
| DE | 3624451 C2 | * | 10/1996 | |
| EP | 0844963 B1 | * | 6/2000 | F41F 3/07 |

*Primary Examiner* — Benjamin P Lee
(74) *Attorney, Agent, or Firm* — Tracy M. Heims; Apex Juris, pllc

(57) ABSTRACT

The present invention provides a simple and inexpensive torpedo storage and launch system that has a sea-based buoyancy type torpedo storage and launch system that has a torpedo storage and launch apparatus that stores a buoyant rise type torpedo in vertical arrangement, and further has a torpedo launch mechanism unit that has an outer peripheral surface made of a material that minimizes electric or acoustic wave reflection, that is arranged on the sea floor, whereby automatic ship detection is performed by remote control from a radar station or the like or by a sonar and controlling means provided in the torpedo storage and launch apparatus itself so that if a ship comes into an encounter position and time then the torpedo is launched from the sea floor, rises by buoyancy, and detonates on collision with the ship, thereby torpedoing the ship.

5 Claims, 7 Drawing Sheets

(56) References Cited

U.S. PATENT DOCUMENTS

| | | | | |
|---|---|---|---|---|
| 5,542,333 | A * | 8/1996 | Hagelberg et al. | 89/1.81 |
| 5,828,571 | A * | 10/1998 | Bessacini et al. | 701/23 |
| 6,044,745 | A * | 4/2000 | Hickey | 89/1.809 |
| 6,371,003 | B1 * | 4/2002 | Hickey | 89/1.81 |
| 7,032,530 | B1 * | 4/2006 | Ansay et al. | 114/319 |
| 8,161,899 | B1 * | 4/2012 | Smallin | 114/238 |
| 8,281,731 | B2 * | 10/2012 | Vosburgh | 114/319 |
| 8,596,181 | B2 * | 12/2013 | Root, Jr. | 89/1.81 |
| 2010/0000463 | A1 * | 1/2010 | Root, Jr. | 114/316 |

* cited by examiner

SEA-BASED BUOYANCY TYPE TORPEDO STORAGE AND LAUNCH SYSTEM, TORPEDO STORAGE AND LAUNCH APPARATUS, AND BUOYANT RISE TYPE TORPEDO

BACKGROUND OF THE INVENTION

1. Field of the Invention

The present invention relates to a sea-based buoyancy type torpedo storage and launch system, a torpedo storage and launch apparatus, and a buoyant rise type torpedo that are simple and inexpensive and exercise an excellent defensive function in surrounding sea areas of a deserted island or the like that is part of a territory where surveillance agents are not present and defensive weapons and others are not deployed either.

It is to be noted that the sea-based buoyancy type torpedo storage and launch system can cope with installation in an environment of hard solid materials such as rocks where the sea floor is not flat as different from sand.

2. Description of the Related Art

For example, when a ship or the like has illegally navigated into surrounding sea areas of a deserted island which is part of a territory, it is often the case that surveillance agents are not present on a landside of the deserted island as a matter of course and defensive weapons and others are not deployed either. In such a case, deploying simple defending means in the surrounding sea areas of the deserted island is demanded for protection of a country.

In regard to a torpedo storage and launch system used for such a purpose, various technologies have been conventionally developed.

Patent Literature 1 discloses a light torpedo type weapon storage and launch container equipped with: a stacking apparatus; an armament interlocking apparatus coupled with the torpedo type weapon; a remote control apparatus coupled with a weapon having a remote control connector; supplying and discharging means for launching the weapon and also supplying and discharging compressed air required for separating the armament interlocking apparatus from the remote control apparatus; and a pullout apparatus that enables the remote control connector to reach the pullout apparatus through the compressed air.

However, this light torpedo type weapon storage and launch container according to Patent Literature 1 is configured on the premise of launch from a surface vessel, an operator is naturally required as a matter of course, and a configuration of the launch container is complicated and expensive. To horizontally move on a sea surface or in waters, compressed air must be supplied to a rear portion of a torpedo from a tank.

Patent Literature 1: Japanese Unexamined Patent Application Publication No. 2001-504934

SUMMARY OF THE INVENTION

A problem to be solved by the present invention is that many torpedo storage and launch systems that are simple and inexpensive, and configured to exercise an excellent defensive function and to cover a wide range without requiring a tank filled with compressed air are not present in surrounding sea areas of a deserted island or the like that is part of a territory where surveillance agents do not exist and defensive weapons and others are not deployed either.

According to the present invention, there is provided a sea-based buoyancy type torpedo storage and launch system, wherein a torpedo storage and launch apparatus that has a buoyant rise type torpedo stored in vertical arrangement, comprises a torpedo launch mechanism unit, and has an outer peripheral surface made of a material on which electric waves or acoustic waves are hardly reflected is arranged on the sea floor in advance, automatic detection is carried out by remote control from a radar station or the like or by a sonar and controlling means provided in the torpedo storage and launch apparatus itself when an attack target has navigated, an encounter position and an encounter time relative to the attack target are determined, the torpedo is launched upward from the sea floor and allowed to rise by buoyancy, and buoyancy gases themselves are exploded by collision, thereby torpedoing the attack target.

It is to be noted that the sea-based buoyancy type torpedo storage and launch system can cope with installation in an environment of hard solid materials such as rocks where the sea floor is not flat as different from sand.

According to the invention of claims 1 and 2, it is possible to realize and provide the sea-based buoyancy type torpedo storage and launch system that does not require a large-scale torpedo launch apparatus and others, does not require an operator either, can inexpensively realize a simple configuration that can detect a ship with use of the radar, control a position of a torpedo by a GPS or automatically detect the ship, launch the torpedo from the sea floor, allow the torpedo to rise by buoyancy, and attack the ship with the torpedo when an arbitrary number of torpedo storage and launch apparatuses each having the torpedo in vertical arrangement are scattered and deployed on the sea floor in surrounding sea areas of an island which is, e.g., part of a territory and the ship as an attack target illegally intruding territorial seas has navigated, the system being hardly detected by a sonar or the like of the ship and exercising an excellent function as a sea-based type.

It is to be noted that the sea-based buoyancy type torpedo storage and launch system can cope with installation of in an environment of hard solid materials such as rocks where the sea floor is not flat as different from sand as a matter of course.

According to the invention of claims 3 and 4, since the anchor body, the storage body portion, a buoyant body portion are wholly made of the material on which electric waves or acoustic waves are hardly reflected, it is possible to realize and provide the torpedo storage and launch apparatus that is hardly detected by a sonar or the like of ships of other countries, can stably support the torpedo in vertical arrangement, can accurately launch the torpedo toward a ship which is an attack target, and is very effective as the sea-based type.

According to the invention of claims 5 and 6, it is possible to realize and provide the buoyant rise type torpedo that enables the torpedo to rise by the buoyancy and collide with a ship while constantly maintaining a torpedo main body in a vertical posture, can explode the explosive unit based on a precipitous reaction of the hydrogen gas and the oxygen gas, attack the ship by using the torpedo, and exercises the excellent attack function even though the torpedo has a simple and inexpensive configuration without providing the propulsion apparatus. Furthermore, according to the invention of claim 7, the configuration including many hydrogen gas balloons and oxygen gas balloons for buoyant rise that are partitioned and accommodated in the upper portion of the torpedo main body by using the partition material, and the fracturing pin that pierces the hydrogen gas balloons, the oxygen gas balloons, and the partition material upon receiving impact force at the time of collision with an attack target can exercise the same effect as the invention of claims 5 and 6.

DETAILED DESCRIPTION OF THE PREFERRED EMBODIMENTS

Figure 1:
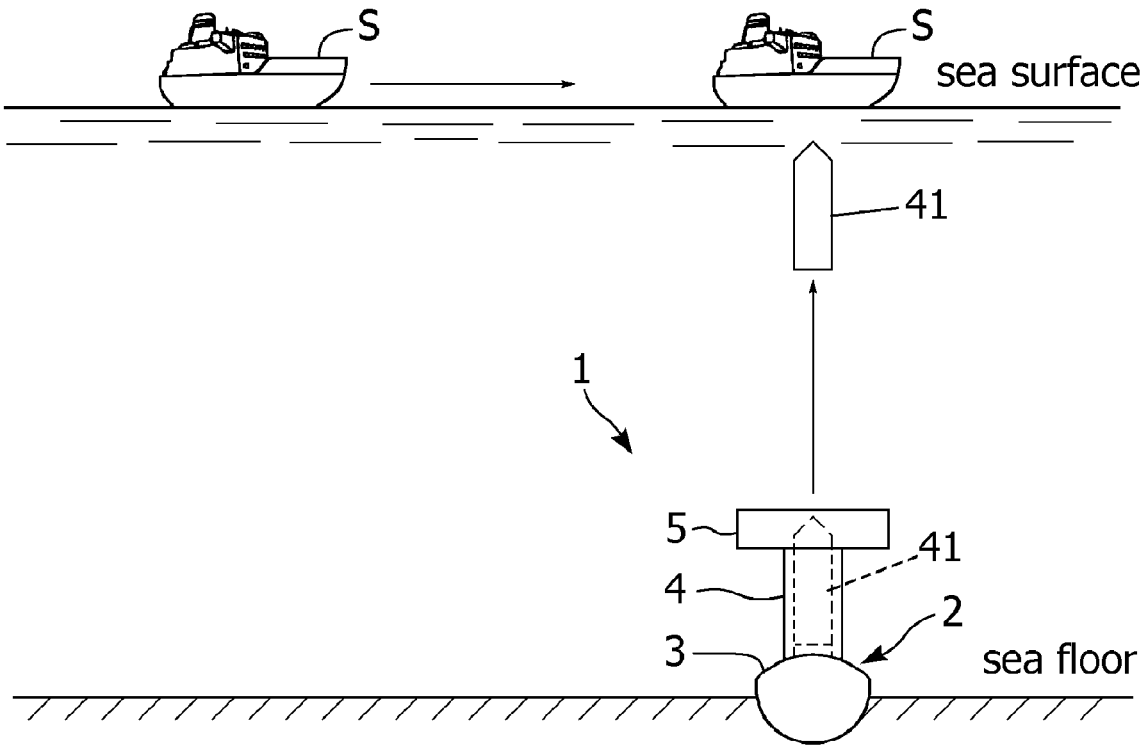
FIG. 1 is a schematic block diagram of a sea-based buoyancy type torpedo storage and launch system according to an embodiment of the present invention.

According to the present invention, the purpose of providing a torpedo storage and launch system that is simple and inexpensive and exercises an excellent defensive function in surrounding sea areas of a deserted island or the like that is part of a territory where surveillance agents do not exist and defensive weapons and others are not deployed is achieved by configuring a sea-based buoyancy type torpedo storage and launch system comprising: a torpedo storage and launch apparatus that comprises an anchor body installed on the sea floor, a cylindrical storage body portion for torpedo storage that is provided on the anchor body, a hollow buoyant body portion that is coupled with an upper end of the storage body portion and has a torpedo launch opening provided in an upper surface and has the storage body portion in vertical arrangement upon receiving buoyancy from seawater, a torpedo launch mechanism unit that launches the torpedo upward from the opening; and controlling means for performing automatic detection by remote control from a radar station or the like or by using a sonar when a ship as an attack target has navigated, determining an encounter position and an encounter time relative to the ship, and operating the torpedo launch mechanism portion, outer peripheral surfaces of the anchor body, the storage body portion, and the buoyant body portion being made of a material on which electric waves or acoustic waves are hardly reflected; and a buoyant rise type torpedo that comprises a hollow rocket-shaped torpedo main body made of a synthetic resin material, a detonation/buoyancy mechanism portion that comprises many hydrogen gas balloons and oxygen gas balloons for buoyant rise accommodated in an upper portion of the torpedo main body and a fracturing pin that pierces the hydrogen gas balloons and the oxygen gas balloons upon receiving impact force at the time of collision with an attack target, an explosive unit that is accommodated in a lower portion of the detonation/buoyancy mechanism unit and set off in response to a reaction of a hydrogen gas and an oxygen gas involved in fracture of the hydrogen gas balloons and the oxygen gas balloons, and a posture control mechanism unit that is provided in two stages below the explosive unit and performs posture control for maintaining the torpedo main body in the vertical direction by protrusion and retraction of each posture control blade along one horizontal direction relative to the torpedo main body and the other horizontal direction orthogonal to the former direction by motor drive, the torpedo being arranged in the storage body portion and the buoyant body portion with a distal end thereof facing the opening, wherein, when a ship as an attack target has navigated, automatic detection is performed by remote control from a radar station or the like or by a sonar and controlling means provided in the torpedo storage and launch apparatus itself, an encounter position and an encounter time relative to the attack target are determined, the torpedo is launched upward from the sea floor and allowed to rise by buoyancy, and the buoyant gas itself is set off by collision, thereby torpedoing the attack target.

It is to be noted that the sea-based buoyancy type torpedo storage and launch system can cope with installation in an environment of hard solid materials such as rocks where the sea floor is not flat as different from sand as a matter of course.

A sea-based buoyancy type torpedo storage and launch system 1 according to an embodiment of the present invention will now be described hereinafter in detail with reference to the drawings.

As shown in FIG. 1, the sea-based buoyancy type torpedo storage and launch system 1 according to this embodiment has a configuration that an arbitrary number of torpedo storage and launch apparatuses 2 each having a torpedo 41 stored in vertical arrangement are scattered and deployed on the sea floor of, e.g., a surrounding sea area of an island that is part of a territory, a ship S that intrudes in territorial waters is automatically detected when this ship S has navigated, the torpedo 41 is launched from the sea floor and allowed to rise by the buoyancy, and the ship S is torpedoed.

Figure 2:
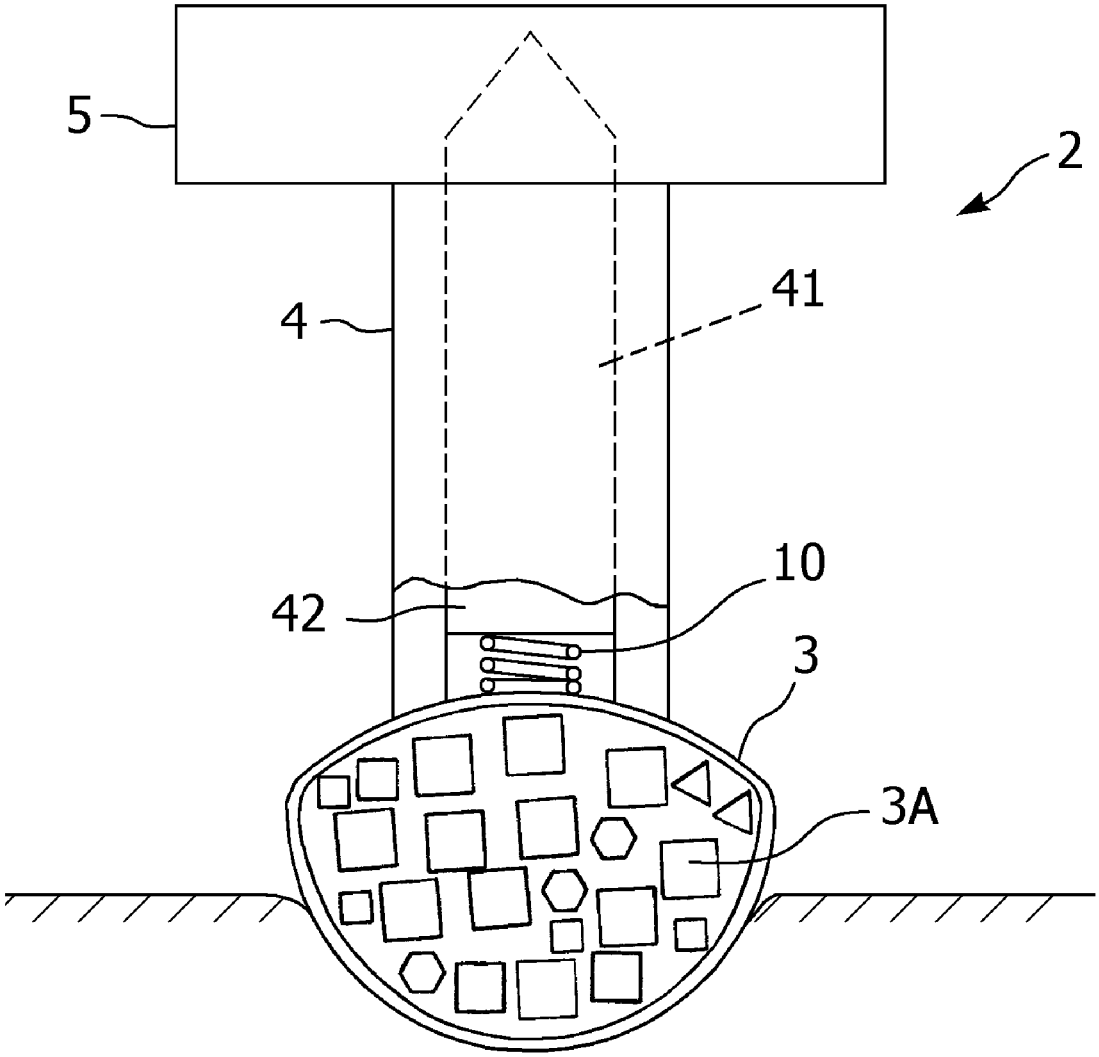
FIG. 2 is a schematic cross-sectional view showing a torpedo storage and launch apparatus and a buoyant rise type torpedo configuring the sea-based buoyancy type storage and launch system according to this embodiment.

As shown in FIG. 2 in an enlarged manner, the torpedo storage and launch apparatus 2 has an integral configuration including, e.g., a spherical or semi-spherical anchor body 3 that enables installation in a stable state in accordance with a shape of the sea floor, a hollow cylindrical storage body portion 4 that is partitioned from an upper surface of this anchor body 3 and arranged to face the vertically upper side; and a hollow discoid buoyant body portion 5 coupled with an upper end of the storage body portion 4.

An inner region of a coupling portion between the buoyant body portion 5 and the storage body portion 4 is opened, the buoyant body portion 5 and the storage body portion 4 form a space that communicates with these portions on the inner side, and the torpedo 41 is vertically arranged in this space.

The anchor body 3, the storage body portion 4, and the buoyant body portion 5 are made of a synthetic resin material as a whole so that they can be hardly detected by a sonar from the ship S of any other country, or they are formed of a synthetic resin layer containing a metal material, FRP, polyester, nylon, an olefin film, or the like composite-laminated on an entire outer peripheral surface of this metal material.

The anchor body 3 is filled with heavy loads 3A such as concrete masses, the entire torpedo storage and launch apparatus 2 can be installed on the sea floor in a stable posture, and the storage body portion 4 is vertically arranged.

A central opening 6 is formed at a central part of an upper surface of the torpedo launch mechanism unit 7, and the torpedo launch mechanism unit 7 is accommodated therein.

The torpedo launch mechanism unit 7 comprises a lid opening/closing mechanism unit 8 including a slide lid 9 arranged below the central opening 6 of the buoyant body portion 5 and a launch spring body 10 that biases the torpedo 41 arranged on an upper surface of the anchor body 3 toward a sea surface side, a lower end of the torpedo 41 is placed on this launch body portion 10, and an upper end of the torpedo 41 faces a lower surface of the slide lid 9.

Furthermore, the inner regions of the buoyant body portion 5 and the storage body portion 4 are filled with air or an inert gas such as a nitrogen gas in a hermetically sealed state, the buoyancy provided by seawater is mainly received by the lower surface of the buoyant body portion 5, and the entire torpedo storage and launch apparatus 2 is held in a stable posture with the central opening 6 of the buoyant body portion 5 constantly facing the sea surface side in particular.

Figure 3:
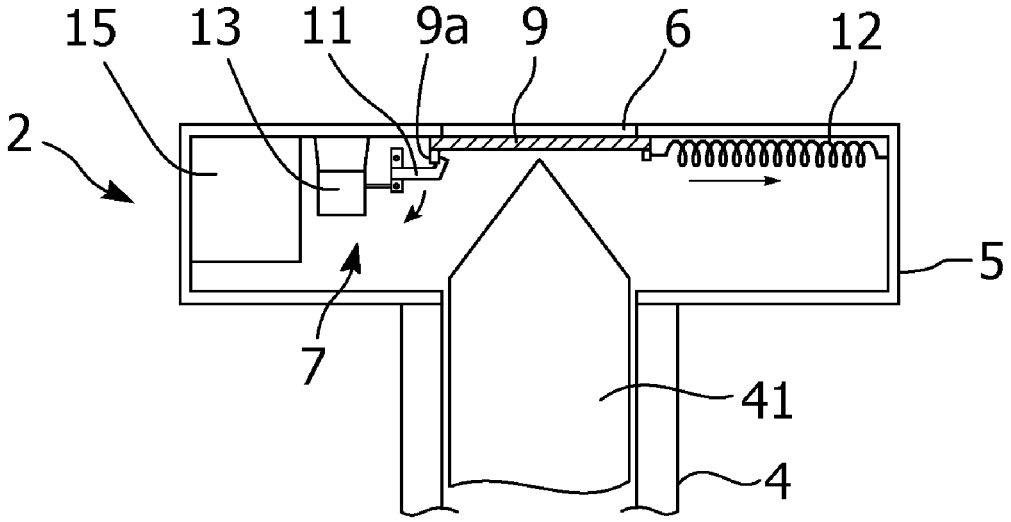
FIG. 3 is a partially enlarged cross-sectional view of the torpedo storage and launch apparatus configuring the sea-based buoyancy type torpedo storage and launch system according to this embodiment.

As shown in FIG. 3, the lid opening/closing mechanism unit 8 comprises the slide lid 9 that is arranged to usually close the central opening 6 of the buoyant body portion 5, a revolving hook 11 that is arranged in the buoyant body portion 5 to allow its revolving movement and engages with an engagement protruding piece 9*a* provided at one end of the slide lid 9 to lock the slide lid 9 at a home position, a tension spring 12 that is arranged in the buoyant body portion 5 and configured to pull the slide lid 9 along a direction of an arrow X, and a lid opening actuator 13 that is arranged in the buoyant body portion 5 and turns and displaces the revolving hook 11 to disengage the slide lid 9 so that the slide lid 9 can be slid by tensile force of the tension spring 12 and move to the lateral side of the central opening 6.

It is to be noted that, as a conformation or a shape of the buoyant body portion 5, besides the hollow discoid shape, a hollow rectangular parallelepiped three-dimensional object, a hollow triangular three-dimensional object, or a hollow cruciform three-dimensional object can be adopted, and it is not restricted in particular.

The torpedo storage and launch apparatus 2 has a sonar (an active sonar) 14 that detects a direction, a distance, and a speed of the ship S as a target of attack and a control box 15 that includes respective elements of a control system which will be described later arranged in the buoyant body portion 5.

The torpedo 41 will now be described in detail with reference to FIG. 4 and FIG. 5.

For example, the torpedo 41 comprises; a hollow torpedo main body 42 having a distal end formed into a cone-like rocket shape with use of a synthetic resin; a detonation/buoyancy mechanism unit 46 constituted of many hydrogen gas balloons 43 and oxygen gas balloons 44 accommodated in an upper portion of this torpedo main body 42 and a plurality of fracturing pins 45 protruding from an inner wall surface of the torpedo main body 42; an explosive unit 47 made of a predetermined amount of explosive accommodated in a lower portion of the detonation/buoyancy mechanism unit 46 in the torpedo main body 42; a posture control mechanism unit 48 provided below the explosive unit 47 in the torpedo main body 42 to be apart from a first partition plate 50*a*, and a posture controller 49, which will be described later in detail, is provided below (the lowermost portion) the posture control mechanism unit 48 in the torpedo main body 42 to be away from a third partition plate 50*c*.

Each hydrogen gas balloon 43 is obtained by filling a bag of a synthetic resin which is a simple substance or complex substances including nylon, polyester, PVC, PP, PE, or the like with a hydrogen gas and sealing this bag, and each oxygen gas balloon 44 is obtained by filling a bag of a simple substance or complex substance of synthetic resin materials including nylon, polyester, PVC, PP, PE, or the like and sealing this bag.

The posture control mechanism unit 48 has a first posture control unit 51 and a second posture control unit 61 that are provided on two upper and lower stages formed between the first partition plate 50*a* and the third partition plate 50*c* to sandwich a second partition plate 50*b* therebetween and also arranged in X and Y directions orthogonal to the torpedo main body 42.

The first posture control unit 51 comprises a first posture control blade 52 that is displaced through both thick wall portions facing each other along the X direction of the torpedo main body 42, a rack 53 provided on a lower surface of the first posture control blade 52, a first motor 54 arranged on the second partition plate 50*b* provided below the first posture control blade 52, and a pinion 55 that is coupled with a driving shaft of the first motor 54 and meshes with the rack 53.

Likewise, the second posture control unit 61 comprises a second posture control blade 62 that is displaced through both thick wall portions facing each other along the Y direction of the torpedo main body 42, a rack 63 provided on a lower surface of this second posture control blade 62, a second motor 64 arranged on the third partition plate 50*c* provided below the second posture control blade 62, and a pinion 65 that is coupled with a driving shaft of the second motor 64 and meshes with the rack 63.

Figure 5:
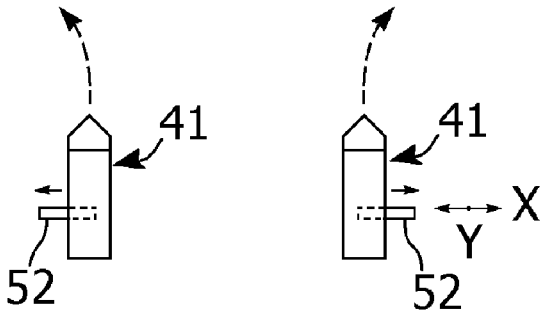
FIG. 5 is an explanatory view showing a posture controlled state of the buoyant rise type torpedo configuring the sea-based buoyancy type torpedo storage and launch system according to this embodiment.

With such a configuration of the first posture control unit 51, as shown in a right section of FIG. 5, when the torpedo 41 rises in seawater by buoyancy, the torpedo 41 changes its posture so as to turn clockwise by driving the first motor 54 to rotate and protruding the first posture control blade 52 toward the right side of the torpedo main body 42 in the X direction through the rack 53 and the pinion 55. In contrast, as shown in a left section of FIG. 5, when the torpedo 41 rises in seawater by buoyancy, the torpedo 41 changes its posture so as to turn counterclockwise by driving the first motor 54 to rotate and protruding the first posture control blade 52 toward the left side of the torpedo main body 42 in the X direction through the rack 53 and the pinion 55.

Moreover, in the second posture control unit 61, when the torpedo 41 rises in seawater by buoyancy, the torpedo 41 is subjected to the posture control in the Y direction based on the same operation as that in case of the first posture control unit 51.

Based on such control, when the torpedo 41 rises in seawater by buoyancy, even if ocean current force acts on this torpedo 41, the torpedo 41 can be allowed to rise by buoyancy while constantly stably holding the posture of the torpedo main body 42 in the vertical direction.

The rotational drive of the first motor 54 of the first posture control unit 51 and the second motor 64 of the second posture control unit 61 is executed by control of the posture controller 49.

Figure 6:
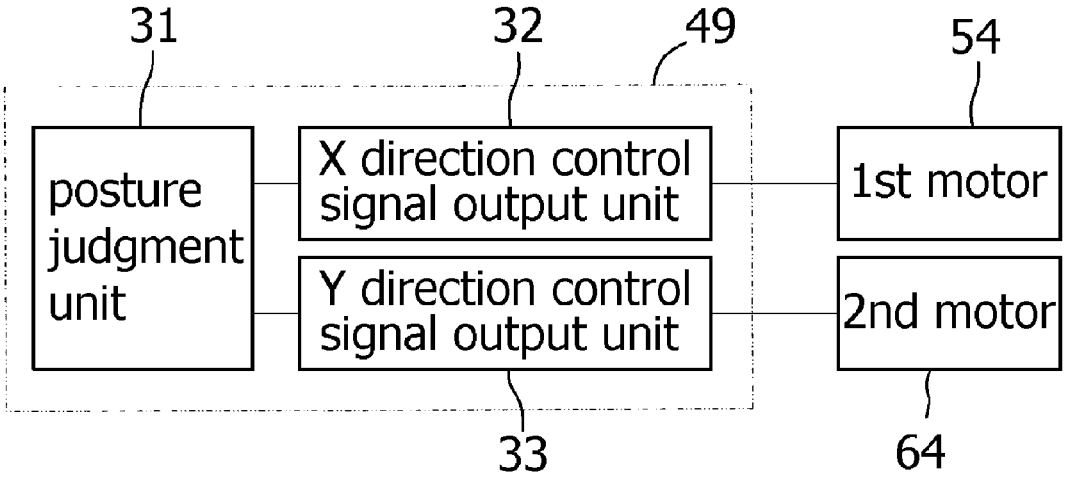
FIG. 6 is a block diagram showing a configuration of a posture controller mounted in the buoyant rise type torpedo in the sea-based buoyancy type torpedo storage and launch system according to this embodiment.

That is, as shown in FIG. 6, the posture controller 49 includes a posture judgment unit 31 that judges a posture (an inclination in the X direction or the Y direction) of the torpedo main body 42, an X direction control signal output unit 32 that outputs an X direction control signal to the first motor 54 based on a judgment result of this posture judgment unit 31, a Y direction control signal output unit 33 that outputs a Y direction control signal to the second motor 64 based on a judgment result of the posture judgment unit 31, and a power supply unit like a storage battery that is not shown but supplies necessary electric power to each element.

Figure 7:
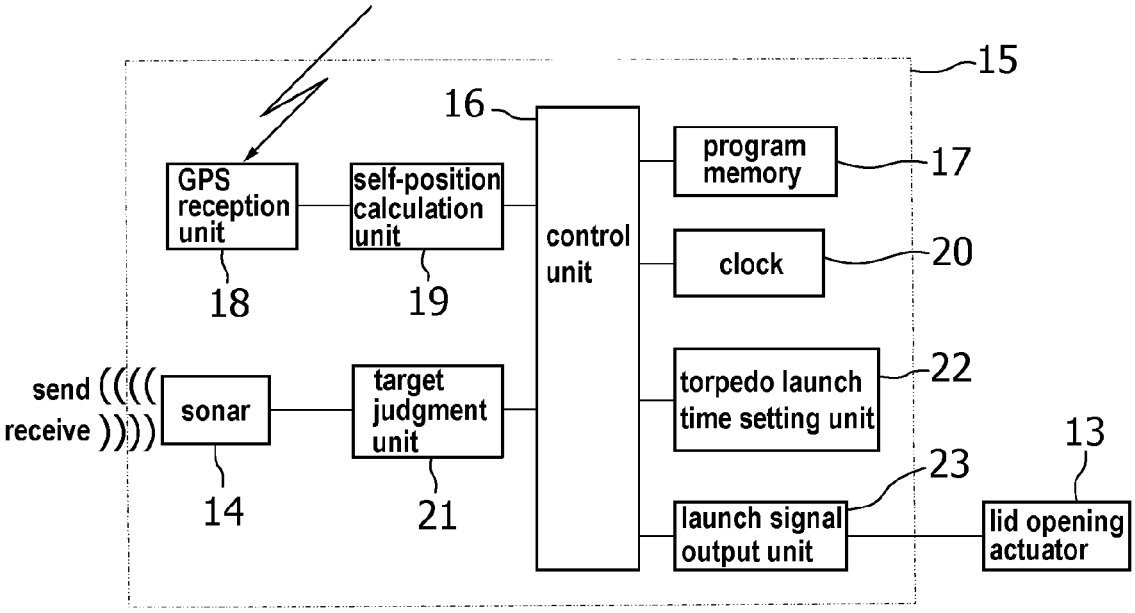
FIG. 7 is a block diagram showing a control system of the torpedo storage and launch apparatus in the sea-based buoyancy type torpedo storage and launch system according to this embodiment.

The control system of the torpedo storage and launch apparatus 2 will now be described with reference to FIG. 7.

The control system of the torpedo storage and launch apparatus 2 comprises a control unit 16 that performs overall control, a program memory 17 that stores an operating program of the torpedo storage and launch apparatus 2, a GPS reception unit 18 that receives a GPS signal from a non-illustrated GPS satellite, a self-position calculation unit 19 that calculates self-position (longitude, latitude) information of the torpedo storage and launch apparatus 2 itself based on the GPS signal received by the GPS reception unit 18, a sonar 14 that emits acoustic waves toward the ship S and receives reflected waves, a clock 20 that outputs accurate time information, a target judgment unit 21 that calculates a direction, a distance, and a speed of the ship S relative to the torpedo storage and launch apparatus 2 based on a signal of the reflected waves from the ship S obtained by the sonar 14 and the time information from the clock 20, a torpedo launch time setting unit 22 that determines an encounter time at which the ship S reaches a position substantially immediately above the torpedo storage and launch apparatus 2 and also sets a torpedo launch time that determines a launch time based on a time required for the torpedo 41 to rise to the sea surface set by the operating program in advance, the information of the direction, the distance, and the speed of the ship S, and the self-position information of the torpedo storage and launch apparatus 2 itself, a launch signal output unit 23 that transmits a launch signal to the lid opening actuator 13 at the set torpedo launch time, and a power supply unit like a storage battery that is not shown but supplies necessary electric power to each element.

In regard to functions and effects of the sea-based buoyancy type torpedo storage and launch system 1 according to this embodiment, a launch operation for the torpedo 41 performed by the torpedo storage and launch apparatus 2 and an attack operation relative to the ship S effected by the launched torpedo 41 will now be separately described.

It is to be noted that the sea-based buoyancy type torpedo storage and launch system can cope with installation in an environment of hard solid substances like rocks that the sea floor is not flat as different from sand as a matter of course.

(Launch Operation of Torpedo 41)

In the torpedo storage and launch apparatus 2, when the ship S intruding into territorial waters has navigated, detection is carried out at a radar station, then the slide lid 9 of the lid opening/closing mechanism unit 8 in the torpedo storage and launch apparatus 2 is slid in response to a command from this station, the region of the central opening 6 is opened, and the torpedo is launched. Alternatively, acoustic waves are emitted toward the ship S and reflected waves are received with use of the sonar 14. Additionally, the self-position calculation unit 19 calculates self-position information of the torpedo storage and launch apparatus 2 based on a GPS signal received by the GPS reception unit 18.

Then, the target judgment unit 21 calculates a direction, a distance, and a speed of the ship S relative to the torpedo storage and launch apparatus 2 based on the signal of the reflected waves from the ship S obtained by the sonar 14 and the time information from the clock 20.

The torpedo launch time setting unit 22 determines an encounter time at which the ship S reaches a position substantially immediately above the torpedo storage and launch apparatus 2 and sets a torpedo launch time used for determining a launch time based on the time required for the torpedo 41 to rise to the sea surface set by the operating program in advance, the information of the direction, the distance, and the speed of the ship S, and the self-position information of the torpedo storage and launch apparatus 2 itself.

The launch signal output unit 23 transmits a launch signal to the lid opening actuator 13 at the set torpedo launch time.

As a result, the revolving hook 1 in the lid opening/closing mechanism unit 8 revolves in a direction of an arrow shown in FIG. 3, the slide lid 9 is disengaged, the slide lid 9 slides in the direction of the arrow shown in FIG. 3 by spring force of the tension spring 12, and the region of the central opening 6 is opened.

At the same time, the torpedo 41 is upwardly launched toward the sea surface in the vertical direction from the central opening 6 by biasing force of the launch spring body 10.

(Attack Operation for Ship S by Torpedo 41)

An attack operation for the ship S by the launched torpedo 41 will now be described.

The torpedo 41 launched by the torpedo storage and launch apparatus 2 rises toward the upper sea surface along the vertical direction upon receiving buoyancy from seawater.

At this time, even if ocean current force acts on the torpedo 41, the torpedo main body 42 rises by buoyancy while constantly stably maintaining its posture in the vertical direction by such a posture control operation in the X direction as shown in FIG. 5 performed by the first posture control unit 51 and a posture control operation in the Y direction carried out by the second posture control unit 61 under control of the posture controller 49.

Then, when the encounter time at which the ship S reaches the position substantially immediately above the torpedo storage and launch apparatus 2 has come, the distal end of the torpedo 41 collides with the bottom of the ship S.

When the distal end of the torpedo 41 collides with the bottom of the ship S, the distal end of the torpedo 41 is deformed by impact force, the fracturing pins 45 in the detonation/buoyancy mechanism unit 46 pierce the hydrogen gas balloons 43 and the oxygen gas balloons 44, the hydrogen gas and the oxygen gas precipitously react to cause explosion, the explosive unit 47 is set off, and a torpedo attack is executed to immediately sink or damage the ship S.

As described above, according to the sea-based buoyancy type torpedo storage and launch system 1 of this embodiment, it is possible to realize the sea-based buoyancy type torpedo storage and launch system 1 that can be inexpensively realized with the simple configuration that the arbitrary number of the torpedo storage and launch apparatuses 2 each storing the torpedo 41 in the vertical arrangement are scattered and arranged on the sea floor of surrounding sea areas of, e.g., an island which is part of a territory without requiring a large-scale torpedo launch apparatus and the like and without requiring an operator, the ship S illegally intruding into territorial waters is automatically detected when this ship has navigated, the torpedo 41 is launched from the sea floor, and the torpedo 41 is allowed to rise by buoyancy so that the ship S can be torpedoed.

Further, according to this embodiment, since the anchor body 3, the storage body portion 4, and the buoyant body portion 5 in the torpedo storage and launch apparatus 2 are entirely made of the synthetic resin material or formed of the metal material and the synthetic resin layers composite-laminated on an entire outer peripheral surface thereof, the torpedo storage and launch apparatus 2 is hardly detected by a sonar or the like of the ship S of any other country and has the heavy loads 3A made of inorganic materials such as concrete masses filling the inside of the anchor body 3, the entire torpedo storage and launch apparatus 2 can be installed on the sea floor in the stable posture, the storage body portion 4 can be supported in the vertical arrangement by the buoyancy from the seawater acting on the buoyant body portion 5, and hence the torpedo 41 can be supported in the vertical arrangement, thereby realizing the torpedo storage and launch apparatus 2 that is very effective as the sea-based type.

Furthermore, according to this embodiment, the detonation/buoyancy mechanism unit 46 has a lightweight structure including the hydrogen gas balloons 43 and the oxygen gas balloons 44, the torpedo 41 itself can automatically rise by the buoyancy from the seawater, the torpedo main body 42 can be allow to rise by the buoyancy to collide with the ship S while constantly maintaining the posture in the vertical direction by a posture control operation in the X direction performed by the first posture control unit 51 and a posture control operation in the Y direction effected by the second posture control unit 61 based on control of the posture controller 49, and the explosive unit 47 can be set off by utilizing a precipitous reaction of the hydrogen gas and the oxygen gas so that the ship S can be torpedoed, thereby realizing the torpedo 41 that has the simple and inexpensive structure but can exercise the excellent attack function without providing a propulsion apparatus.

Figure 8:
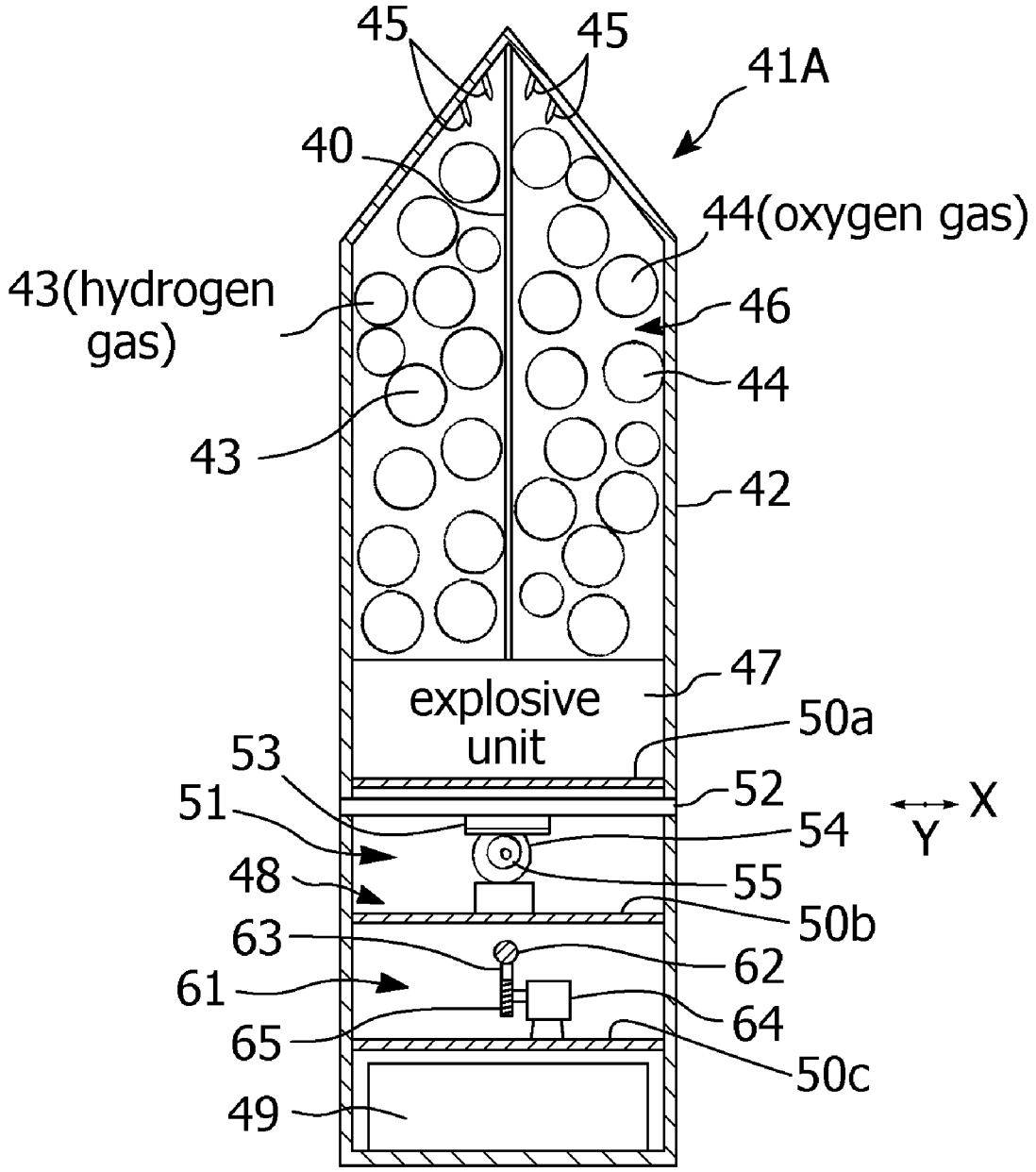
FIG. 8 is an enlarged cross-sectional view showing a modification of the torpedo configuring the sea-based buoyancy type torpedo storage and launch system according to this embodiment.

FIG. 8 shows a torpedo 41A according to a modification of the torpedo 41 in the sea-based buoyancy type torpedo storage and launch system 1 according to this embodiment.

Figure 4:
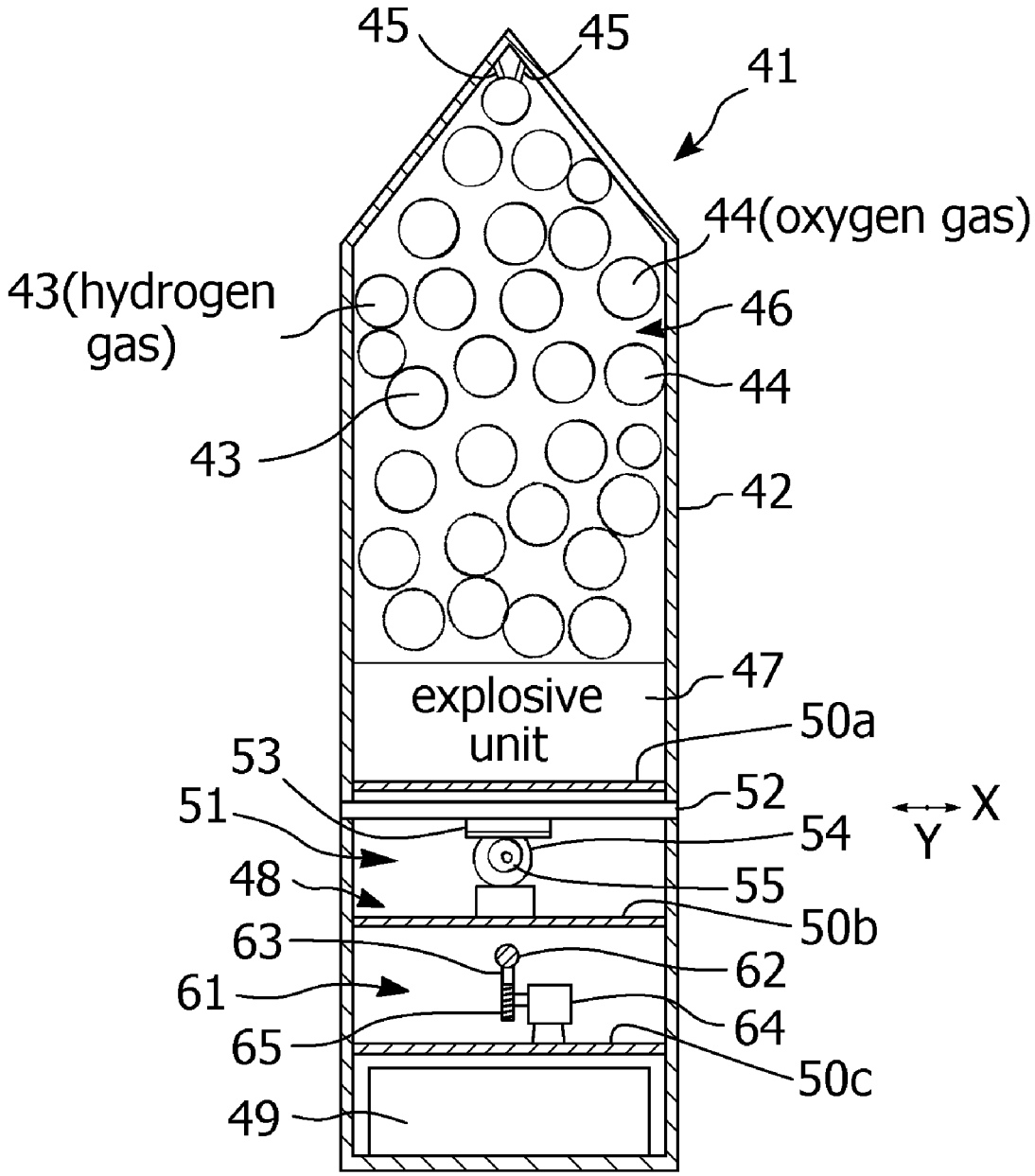
FIG. 4 is an enlarged cross-sectional view of the buoyant rise type torpedo configuring the sea-based buoyancy type torpedo storage and launch system according to this embodiment.

Although this torpedo 41A has the same configuration as the torpedo 41 shown in FIG. 4, but it is configured to include, as a detonation/buoyancy mechanism, many hydrogen gas balloons 43 and oxygen gas balloons 44 for buoyant rise which are accommodated and partitioned in an upper portion of a torpedo main body 2 by using a thin partition material 40 made of, e.g., a synthetic resin film, and fracturing pins 45 that pierce the hydrogen gas balloons 43, the oxygen gas balloons 44, and the partition material 40 upon receiving impact force at the time of collision with an attack target.

Such a torpedo 41A according to the modification can exercise the same functions and effects as those of the above-described torpedo 41.

The sea-based buoyancy type torpedo storage and launch system according to the present invention can be extensively applied as defending means in surrounding sea areas of a deserted island or the like constituting part of a territory, part of a territory that is present outside the range of a radar surveillance network, or territorial waters.

What is claimed is:

1. A sea-based buoyancy type torpedo storage and launch system comprising:

a torpedo storage and launch apparatus comprising:

an anchor body installed on a sea floor;

a cylindrical storage body portion for said torpedo storage that is provided on the anchor body;

a hollow, buoyant body portion that is coupled with an upper end of the cylindrical storage body portion and has a torpedo launch opening provided in an upper surface, and that has the cylindrical storage body portion in vertical arrangement upon receiving buoyancy from seawater;

a torpedo launch mechanism unit that launches a torpedo upward from the opening; and controlling means for performing automatic detection by remote control from a radar station or the like or by using a sonar when a vessel navigates into an unallowed position it becomes an attack target whereafter, determining an encounter position and an encounter time relative to the attack target, and operating the torpedo launch mechanism portion, where outer peripheral surfaces of the anchor body, the storage body portion, and the buoyant body portion are made of a material that is reflection resistant to electric waves or acoustic waves; and a buoyant, rise type torpedo comprising:

a hollow, rocket-shaped torpedo main body made of a synthetic resin material;

a detonation/buoyancy mechanism portion that comprises hydrogen gas balloons and oxygen gas balloons for buoyant rise accommodated in an upper portion of the torpedo main body and a fracturing pin that pierces the hydrogen gas balloons and the oxygen gas balloons upon receiving impact force at a time of collision with said attack target;

an explosive unit that is accommodated in a lower portion of the detonation/buoyancy mechanism unit that is set off in response to a reaction of a hydrogen gas and an oxygen gas involved in fracture of the hydrogen gas balloons and the oxygen gas balloons; and a posture control mechanism unit that is provided in two stages below the explosive unit and performs posture control for maintaining the torpedo main body in the vertical direction by protrusion and retraction of each posture control blade along one horizontal direction relative to the torpedo main body and the other horizontal direction orthogonal to the former direction by a motor drive, the torpedo being arranged in the storage body portion and the buoyant body portion with a distal end thereof facing the opening, wherein when said attack target navigates into said unallowed position automatic detection is performed by remote control from a radar station or the like or by a sonar and controlling means provided in the torpedo storage and launch apparatus itself, an encounter position and an encounter time relative to the attack target are determined, the torpedo is launched upward from the sea floor and allowed to rise by buoyancy, and the buoyant gas itself is set off by collision, thereby torpedoing the attack target.

2. A torpedo storage and launch system comprising:

an anchor body that is installed on a sea floor;

a hollow cylindrical storage body portion that stores a buoyant rise type torpedo above the anchor body and in a state that can launch the torpedo upward from the sea floor, the buoyant rise torpedo comprising:

a hollow torpedo main body made of a synthetic resin material;

a detonation/buoyancy mechanism unit comprising hydrogen gas balloons and oxygen gas balloons for buoyant rise accommodated in an upper portion of the torpedo main body and a fracturing pin that pierces the hydrogen gas balloons and the oxygen gas balloons upon receiving impact force at a time of collision with an attack target;

an explosive unit that is accommodated in a lower portion of the detonation/buoyancy mechanism unit and set off in response to a reaction of a hydrogen gas and an oxygen gas involved by fracture of the hydrogen gas balloons and oxygen gas balloons; and a posture control mechanism unit that is provided in a lower portion of the explosive unit and performs posture control for maintaining a posture of the torpedo main body in a vertical direction;

a hollow buoyant body portion that has a hollow box-like upper portion, is coupled with an upper end of the storage body portion, has a torpedo launch central opening in an upper surface thereof, has the storage body portion in vertical arrangement upon receiving buoyancy from the seawater, includes an upper portion of the torpedo, and has a distal end of the torpedo facing the central opening side;

a torpedo launch mechanism unit comprising:

a slide lid that usually closes the central opening;

a lid opening actuator mechanism that slides the slide lid and opens the central opening; and a launch spring body that biases the torpedo toward the upper side of the central opening; and controlling means for performing automatic detection by remote control from a radar station or the like or by using a sonar when a vessel navigates into an unallowed position whereafter said vessel then becomes the attack target, determining an encounter position and an encounter time with respect to the attack target, operating the torpedo launch mechanism unit, opening the central opening, and allowing the torpedo to rise toward the attack target by buoyancy, wherein the anchor body includes a spherical or semi-spherical shape that enables installation of the storage body portion in vertical arrangement and in a stable state by buoyancy of the buoyant body portion, and in accordance with a shape of the sea floor; and wherein outer peripheral surfaces of the anchor body, the storage body portion, and the buoyant body portion are made of a material that is reflection resistant to electric waves or acoustic waves.

3. A buoyant rise type torpedo comprising:

a hollow torpedo main body made of a synthetic resin material;

a detonation/buoyancy mechanism unit comprising hydrogen gas balloons and oxygen gas balloons for buoyant rise accommodated in an upper portion of the torpedo main body and a fracturing pin that pierces the hydrogen gas balloons and the oxygen gas balloons upon receiving impact force at a time of collision with an attack target;

an explosive unit that is accommodated in a lower portion of the detonation/buoyancy mechanism unit and set off in response to a reaction of a hydrogen gas and an oxygen gas involved by fracture of the hydrogen gas balloons and oxygen gas balloons; and a posture control mechanism unit that is provided in a lower portion of the explosive unit and performs posture control for maintaining a posture of the torpedo main body in a vertical direction.

4. The buoyant rise type torpedo of claim 3, where:

said hollow torpedo is rocket-shaped; and said posture control mechanism unit is provided on two stages in said lower portion of the explosive unit and performs said posture control for maintaining said posture of the torpedo main body in the vertical direction based on protrusion and retraction of each posture control blade along one horizontal direction relative to the torpedo main body and the other horizontal direction orthogonal to the former direction by a motor drive.

5. The buoyant rise type torpedo of claim 4, where:

said gas balloons are partitioned and accommodated in an upper portion of the torpedo main body with use of a partition material.

* * * * *